United States Patent [19]

DeTolla et al.

[11] 4,314,793

[45] Feb. 9, 1982

[54] TEMPERATURE ACTUATED TURBINE SEAL

[75] Inventors: Francis L. DeTolla; Gary F. Chaplin, both of Vernon, Conn.

[73] Assignee: United Technologies Corporation, Hartford, Conn.

[21] Appl. No.: 971,290

[22] Filed: Dec. 20, 1978

[51] Int. Cl.[3] ..... F01D 11/00; F01D 9/04

[52] U.S. Cl. ..... 415/135; 415/137

[58] Field of Search ..... 415/136, 137, 191, 138, 415/115, 216, 217, 134, 135; 60/39.32

[56] References Cited

U.S. PATENT DOCUMENTS

| | | | |
|---|---|---|---|
| 3,075,744 | 1/1963 | Peterson | 415/115 |
| 3,730,640 | 5/1973 | Rice et al. | 415/217 |
| 3,829,233 | 8/1974 | Scalzo | 415/136 |
| 3,945,758 | 3/1976 | Lee | 415/115 |
| 4,126,405 | 11/1978 | Bobo et al. | 415/115 |

FOREIGN PATENT DOCUMENTS

| | | | |
|---|---|---|---|
| 491905 | 4/1953 | Canada | 415/115 |
| 1258661 | 1/1968 | Fed. Rep. of Germany | 415/115 |

*Primary Examiner*—Robert E. Garrett

*Attorney, Agent, or Firm*—Gene D. Fleischhauer

[57] ABSTRACT

A seal member for a gas turbine engine is disclosed. Various construction details which ensure an adequate fatigue life and increase the sealing effectiveness of the member during engine operation are developed. A metal diaphragm extends from a nonrotating structure inwardly of the engine flow path to engage the stator vanes at engine operating temperature.

11 Claims, 4 Drawing Figures

124
180
178
168
130
136
172
156
158
134
170
164
176
160
144
126

TEMPERATURE ACTUATED TURBINE SEAL

BACKGROUND OF THE INVENTION

This invention relates to gas turbine engines, and more particularly to a seal member extending between an array of stator vanes and the inner case of such an engine.

A gas turbine engine has a compression section, a combustion section, and a turbine section. The turbine section includes a rotor assembly and a stator assembly. One or more rows of rotor blades extend outwardly on the rotor assembly. The stator assembly includes an outer case and an inner case. One or more rows of stator vanes extend between the outer case and the inner case. An annular flow path for working medium gases extends through the alternating rows of vanes and blades. Working medium gases are pressurized in the compression section, burned with fuel in the combustion section and expanded in the turbine section. The temperature of the working medium gases discharging from the combustion section into the turbine often exceed fourteen hundred degrees Celsius (1400° C.).

The hot gases entering the turbine section lose heat to the stator vanes and the inner case causing thermal growth of the vanes and the inner case. These vanes are cooled to prevent a deterioration in physical properties and to ensure an adequate life. The performance of the engine is diminished by the loss of cooling air through leak paths between the vanes and the inner case. Typical constructions using high pressure air as the cooling medium are shown in U.S. Pat. Nos. 3,957,393 to Bandurick entitled "Turbine Disk and Sideplate Construction"; 3,980,411 to Crow entitled "Aerodynamic Seal for a Rotary Machine"; and 4,025,226 to Hovare entitled "Air Cooled Turbine Vane".

As the working medium gases expand through the turbine vanes, the working medium gases exert nonuniform aerodynamic forces on the vanes. These forces are a primary cause of vane vibration. The vibration and the forces can create high stresses in the vanes which ultimately may cause fatigue failure. Accordingly, scientists and engineers are continuing to search for seal structures having good sealing effectiveness between the vanes and the inner case, and an ability to damp vane vibration.

SUMMARY OF THE INVENTION

A primary object of the present invention is to increase the sealing effectiveness of a seal structure which extends circumferentially between a portion of an array of stator vanes and an inner case in an axial flow rotary machine. Another object is to dampen vibratory movement of the vane array. An object is to accommodate the thermal growth of the vane array and the seal structure. Still another object is to ensure an adequate fatigue life for the seal structure.

According to the present invention, a metal diaphragm between an array of stator vanes and an inner case provides sealing therebetween in response to engine operating temperatures.

A primary feature of the present invention is a metal diaphragm having one end engaging the inner case. The metal diaphragm has a center section that is radially flexible and a second end that is axially flexible. Another feature, is a slot which extends radially in each vane to receive the metal diaphragm. The bottom of the slot is radially spaced from the metal diaphragm leaving a gap therebetween. In one detailed embodiment a plurality of rivets engage the metal diaphragm and the inner case.

A principal advantage of the present invention is an effective seal against radial leakage of cooling air into the gas path which results from the positive contact between the metal diaphragm and the array of stator vanes. Vibratory damping results from the positive contact between the metal diaphragm and the vane. Another advantage is the accommodation of thermal growth between each vane and the seal which results from the radial gap and the radial flexibility of the center section of the metal diaphragm. An adequate fatigue life is ensured by the flexible center section.

The foregoing and other objects, features and advantages of the present invention will become more apparent in the light of the following detailed description of preferred embodiments thereof as discussed and illustrated in the accompanying drawing.

DESCRIPTION OF THE PREFERRED EMBODIMENT

Figure 1:
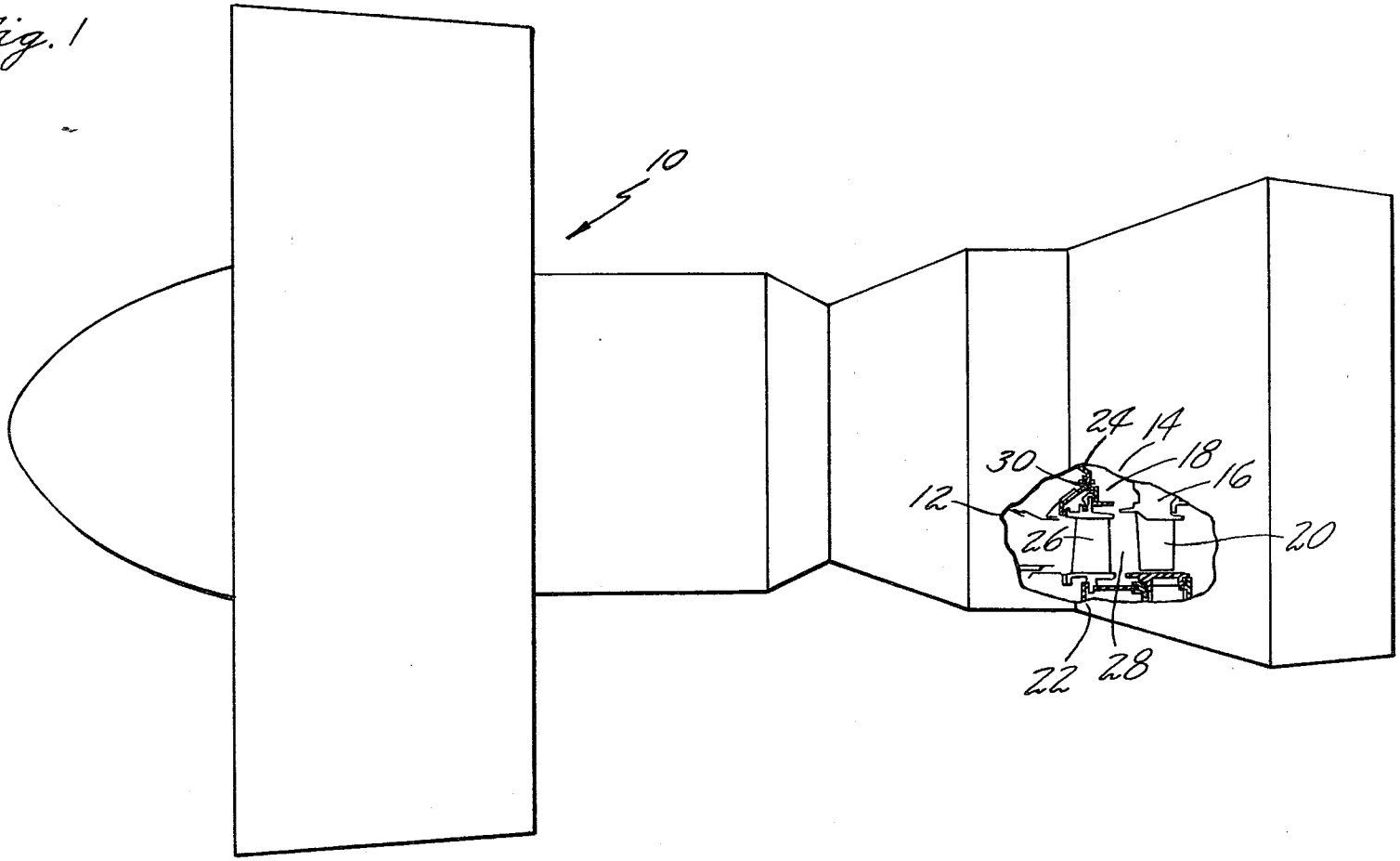
FIG. 1 is a simplified side elevation view of a turbofan engine with a portion of turbine case broken away to reveal a portion of the combustion section and rotor and stator components.

A turbofan, gas turbine engine embodiment of the invention is illustrated in FIG. 1. Principal sections of the engine include a compression section 10, a combustion section 12, and a turbine section 14. The turbine section includes a rotor assembly 16 and a stator assembly 18. The rotor has a row of outwardly extending rotor blades, as represented by the single rotor blade 20. The stator assembly includes outer case 22 and an inner case 24. A row of stator vanes, as represented by the single vane 26, engages both the inner case and the outer case. An annular flow path 28 for working medium gases extends through the alternating rows of vanes and blades. A nonrotating structure inwardly of the flow path includes parts of the stator assembly such as the inner case and a shroud 30. A nonrotating structure outwardly of the flow path includes parts of the stator assembly such as the outer case.

Figure 2:
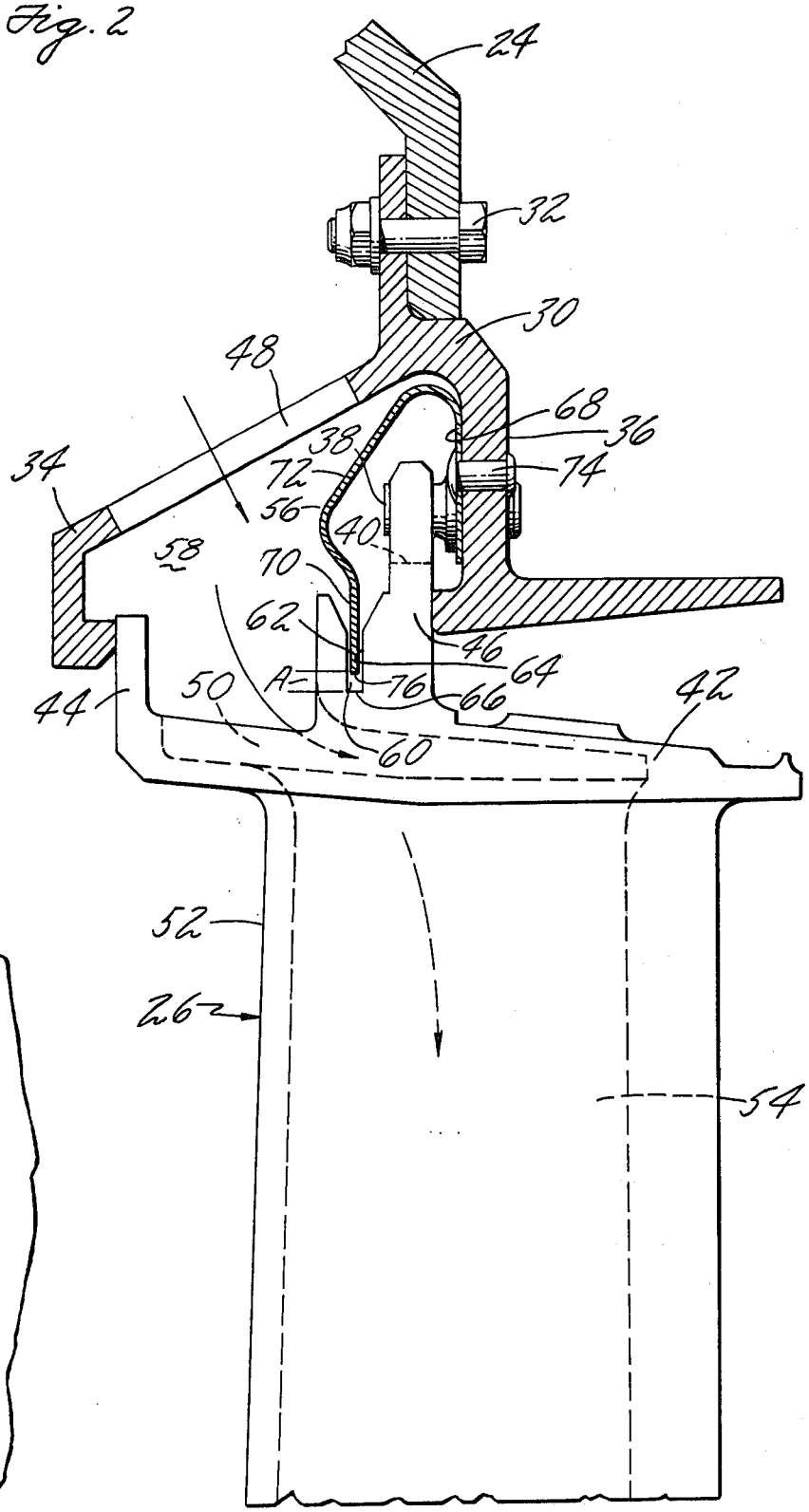
FIG. 2 is a cross section view of a portion of the turbine section showing the engine case and a stator vane.

FIG. 2 is an enlarged, cross section view showing a portion of the inner case 24 and one of the vanes 26. The shroud 30 extends circumferentially about the inner case. The shroud is attached to the inner case by a plurality of bolts 32. The shroud has an upstream flange 34 and a downstream flange 36 extending outwardly from the inner case. The downstream flange extends circumferentially and has a plurality of pins each of which engages a corresponding slot in the vane as represented by the single pin 38 and the single slot 40. Each stator vane 26 has a platform 42. The platform has an upstream flange 44 and a downstream flange 46. The downstream flange of the vane slidably engages the pin 38 and the downstream flange 36 of the shroud. The upstream flange of the vane slidably engages the upstream flange 34 of the shroud. The upstream flange of the shroud extends circumferentially and has a plurality of holes for cooling air, as represented by the single hole 48. Each stator vane has an entrance 50 for cooling air in the platform and an airfoil 52 having a cavity 54 for cooling air in gas communication with the entrance.

A diaphragm 56 engages the inner case and extends circumferentially. The diaphragm extends outwardly from the downstream flange 36 of the shroud 30 towards each of the vanes 26. In at least one detailed embodiment the diaphragm may be formed of more than one piece such as a plurality of circumferentially extending segments. Such a diaphragm typically has a thickness which is in the range of twenty thousandths (0.020) of an inch to thirty thousandths (0.030) of an inch. The diaphragm, the shroud 30 of the inner case, and the platform 44 form a cooling chamber 58. The cooling chamber is in gas communication with the plurality of holes 48 in the case and the entrance 50 for cooling air in each of the vane platforms. Each of the vane platforms has an inwardly facing slot 60. The slot has an upstream surface 62, a downstream surface 64 and a bottom 66. The slot is adapted to receive the diaphragm. The diaphragm has an inner leg 68, an outer leg 70 and a flexible center section 72 having a curved section therebetween. The inner leg 68 is attached to the downstream flange 36 of the shroud by a means for affixing the diaphragm to the shroud such as a plurality of rivets as represented by the single rivet 74. The outer leg 70, disposed in slot 60, has an outer end 76. The outer end of the diaphragm is radially spaced during assembly from the bottom 66 leaving a gap A.

Figure 3:
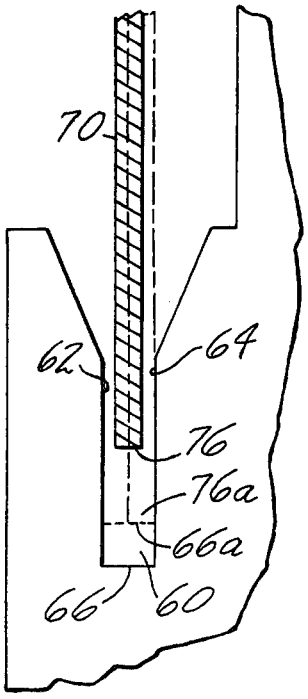
FIG. 3 is an enlarged view of a portion of FIG. 2 which shows the moved position of the vane and a diaphragm.

FIG. 3 is an expanded view of a portion of FIG. 2 showing with dotted lines the steady state positions of the diaphragm 56 and the bottom 66 of the slot. At steady state operating conditions there is no gap A between the outer end 76*a* of the diaphragm 56 and the bottom 66*a* of the slot.

Figure 4:
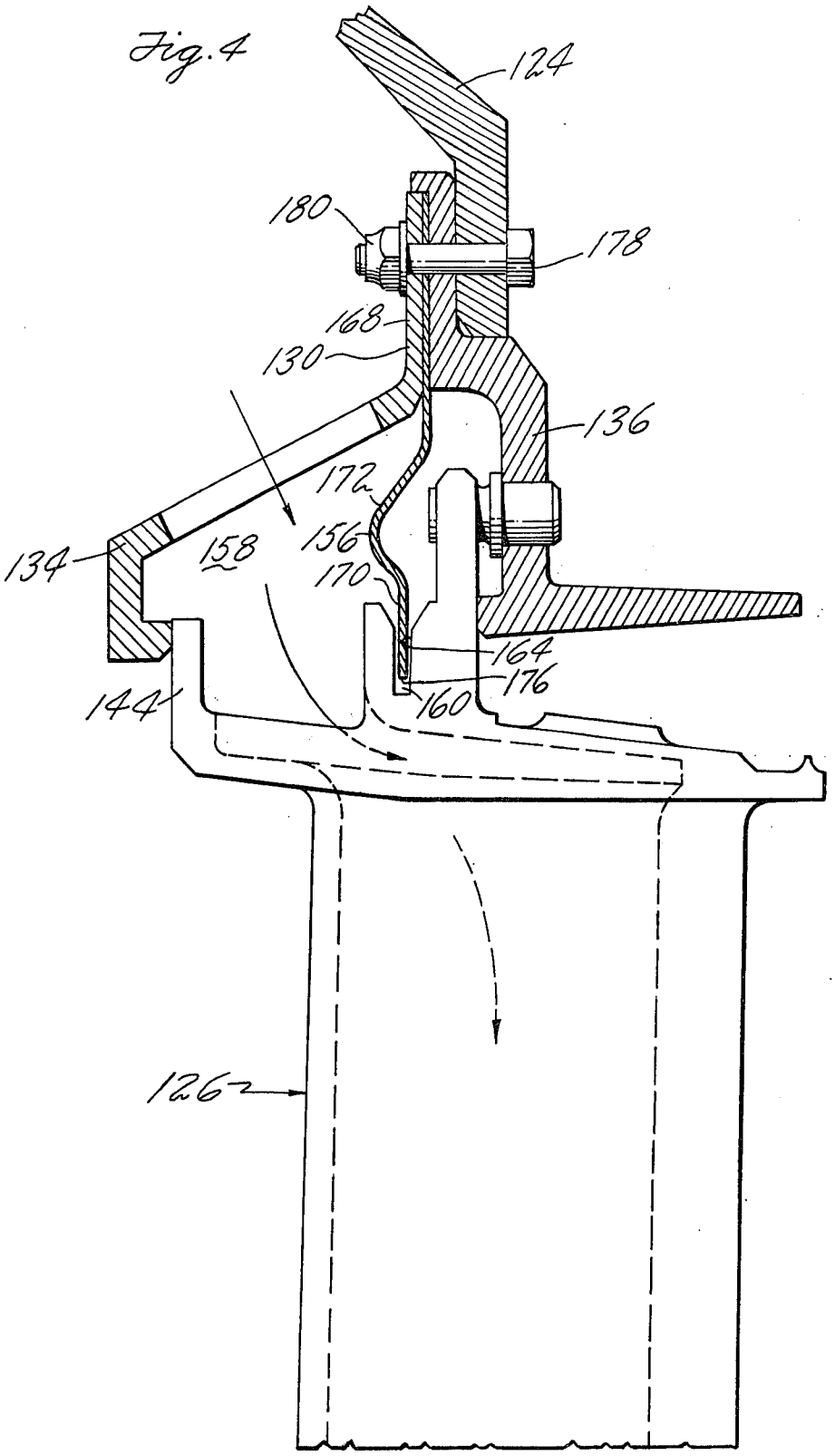
FIG. 4 is a cross section view corresponding to the FIG. 2 view and shows an alternate embodiment.

FIG. 4 is an alternate embodiment of FIG. 2 having a different means of attaching a diaphragm 156 to an inner case 124. A shroud 130 extends circumferentially about the inner case. The shroud 130 includes an upstream flange 134 and a downstream flange 136. A plurality of vanes 126 engages the shroud. Each vane has an upstream flange 144 and a slot 160. The slot has a downstream surface 164. The diaphragm extends across a cooling chamber 158. The diaphragm has an inner leg 168, an outer leg 170, a flexible center section 172 therebetween, and an end 176. The diaphragm is disposed between the upstream flange 134 and the downstream flange 136. A means for applying an axial force such as a plurality of bolts 178 and nuts 180 engages the upstream flange, the diaphragm, the downstream flange and the inner case.

During operation of a gas turbine engine, hot working medium gases are burned in a combustion section. The hot working medium gases flow out of the combustion section along an axial flow path into a turbine section of the engine. Components of the turbine including the outer case 22, the inner case 24, the stator vanes 26 and the circumferentially extending diaphragm 56 are heated by the working medium gases. As the engine approaches steady state conditions, the vane expands and slides inwardly with respect to the shroud 30. The diaphragm expands outwardly to engage the plurality of stator vanes. The gap A allows the diaphragm to operate in the elastic range as the curved section of the diaphragm is compressed by the outward movement of the diaphragm and the inward movement of the vane. The stator vanes, which may be immediately downstream of the combustion section, are bathed in hot working medium gases. The stator vanes require cooling. High pressure cooling air enters the cooling chamber 58 between the vanes and the case to thence flow through the stator vanes to provide cooling.

The diaphragm 56 engages the row of stator vanes 26 and the downstream flange 36 of the shroud in a radially oriented direction to block the leakage of cooling air between the row of stator vanes and the inner case 24. As shown in FIG. 2, the end 76 of the diaphragm presses against the row of stator vanes. Compression of a flexible center section 72 of the diaphragm resulting from thermal growth during operation causes the end of the diaphragm to exert a sealing force in the radial direction against the array of stator vanes. Tolerance differences between adjacent vanes may prevent the positive engagement of the circumferentially extending diaphragm with the bottom of each slot. Because this lack of engagement may result in small leaks, a secondary seal is provided between the outer leg 70 of the diaphragm and the downstream surface 64 of the slot 60. The secondary seal results from a force acting in the axial direction which urges the outer leg rearwardly into contact with the downstream surface. The axial force is produced by the difference in pressure between the cooling air in the chamber 58 and the working medium gases acting on the diaphragm. Some of the vanes of the array may rotate slightly about a radial line. Any such radial rotation causes the sealing contact between the outer leg of the diaphragm and a portion of the downstream surface of the slot to be broken. Any leakage of cooling air caused by this slight rotation of the vanes and by the tolerance differences between adjacent vanes discussed above is inhibited by the tortuous path that any leaking cooling air must follow. The cooling air must flow outwardly between the diaphragm and the upstream surface of the slot, through a one hundred eighty degree (180°) turn at the end 76 of the diaphragm, and then flow inwardly between the diaphragm and the downstream surface of the slot. The air must flow past the inwardly extending flange of the vane through one hundred eighty degree turn around the end of the flange and then must pass between the downstream flange 46 of the vane and the downstream flange of the shroud before the cooling air can reach the gas path.

Vibrational energy in the stator vanes 26 is dissipated as heat both by the rubbing contact between the end 76 of the diaphragm and the bottom 66 of the slot 60 and by the rubbing contact between the outer leg 70 of the diaphragm and the downstream surface 64 of the vane slot. Additional damping in the form of viscous damping results from vibrations in each stator vane being transmitted to the diaphragm. The flexible center section 72 of the diaphragm translates radially and causes pumping of the cooling air.

In a similar fashion cooling air enters the cooling chamber 158 shown in FIG. 4 to pressurize the cooling chamber and to cool the array of stator vanes 126. Compression of the flexible center section 172 during operation causes the end 176 of the diaphragm to exert a sealing force in a radial direction against the vane. Vibrational energy in the vane is dissipated by rubbing between the outer end 176 of the diaphragm and the vane and by rubbing between the outer leg 170 and the downstream surface 164 of the slot 160. Viscous damping of the vane results from the flexible center section translating radially to cause pumping of the cooling air. The inner leg 168 of the diaphragm is trapped axially and radially between the upstream flange 134 of the shroud and the downstream flange 136 of the shroud. The plurality of bolts 178 and nuts 180 causes the upstream flange 134 of the shroud to press tightly against the upstream flange of the vane and exert an axial force. The axial force further inhibits small rotations of any vane about a radial axis.

Although this invention has been shown and described with respect to a preferred embodiment thereof, it should be understood by those skilled in the art that various changes and omissions in the form and detail thereof may be made therein without departing from the spirit and scope of the invention.

Having thus described a typical embodiment of our invention, that which we claim as new and desire to secure by Letters Patent of the United States is:

1. In a gas turbine engine of the type having a nonrotating structure inwardly of an annular flow path for working medium gases and a nonrotating structure outwardly of the engine flow path, the improvement which comprises:

a plurality of vanes extending inwardly across the flow path from the outward structure; and a diaphragm which extends from the inward structure into proximity with the vanes, and which is spaced radially from said plurality of vanes leaving a gap therebetween, and wherein each of said vanes has a coefficient of thermal expansion causing the vanes to grow inwardly in response to engine operating temperatures and said diaphragm has a coefficient of thermal expansion causing the diaphragm to grow outwardly in response to engine operating temperatures such that each of said vanes and said diaphragm are adapted to grow radially a distance larger than the gap to engage in intimate contact in response to engine operating temperatures.

2. The invention according to claim 1 wherein said diaphragm has an axially flexible portion which is adapted to engage said plurality of vanes in response to engine operating pressures.

3. The invention according to claim 1 wherein the diaphragm is formed of a plurality of circumferentially extending segments.

4. The invention according to claims 1 or 2 wherein said diaphragm has, a first leg which engages the inward structure, a flexible center section, and an end which engages said vanes as said diaphragm and said vanes engage in intimate contact.

5. The invention according to claim 4 wherein said flexible center section has a curved portion which is not compressed at installation but is compressed in response to engine operating temperatures.

6. The invention according to claim 5 wherein said diaphragm has a thickness which is in the range of twenty thousandths (0.020) of an inch to thirty thousandths (0.030) of an inch.

7. The invention according to claim 4 wherein the diaphragm has, a second leg which extends between the flexible center section and said end, the second leg having the axially flexible portion which is adapted to engage said plurality of vanes in response to engine operating pressures; and wherein each of said vanes has a circumferentially extending slot adapted to receive a portion of the second leg.

8. The invention according to claim 7 wherein:

said inward structure includes, an inner case, and a shroud having, an upstream flange which extends circumferentially, and a downstream flange which extends circumferentially, said diaphragm is trapped axially and radially between the upstream flange and the downstream flange;

each of said vanes has an upstream flange which engages the upstream flange of the shroud and a downstream flange which engages the downstream flange of the shroud; and the invention further has a means for applying an axial force to the upstream flange of the shroud.

9. The invention according to claim 8 wherein the means for applying an axial force to the upstream flange of the shroud is a plurality of bolts which engage the inner case and a plurality of nuts, each of which engages a corresponding bolt.

10. The invention according to claim 4, which further has a means for affixing the first leg of the diaphragm to the inward structure.

11. The invention according to claim 10 wherein the means for affixing the first leg of the diaphragm to the inward structure is a plurality of rivets which engage the first leg and the inward structure.

* * * * *